US011458751B2

(12) United States Patent
Shintani

(10) Patent No.: US 11,458,751 B2
(45) Date of Patent: Oct. 4, 2022

(54) WINDING DEVICE AND PRINTING SYSTEM

(71) Applicant: SEIKO EPSON CORPORATION, Tokyo (JP)

(72) Inventor: Akihiro Shintani, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 209 days.

(21) Appl. No.: 16/894,506

(22) Filed: Jun. 5, 2020

(65) Prior Publication Data

US 2020/0384785 A1 Dec. 10, 2020

(30) Foreign Application Priority Data

Jun. 6, 2019 (JP) ..... JP2019-105947

(51) Int. Cl.

| | |
|---|---|
| ***B41J 15/16*** | (2006.01) |
| ***B65H 18/16*** | (2006.01) |
| ***B41J 3/407*** | (2006.01) |

(52) U.S. Cl.

CPC ..... *B41J 15/16* (2013.01); *B41J 3/4075* (2013.01); *B65H 18/16* (2013.01)

(58) Field of Classification Search

CPC ..... B41J 15/16; B41J 3/4075; B65H 18/16
See application file for complete search history.

(56) References Cited

U.S. PATENT DOCUMENTS 8,096,717 B2 * 1/2012 Kubota ..... B41J 3/4075 400/621

FOREIGN PATENT DOCUMENTS

| | | | | |
|---|---|---|---|---|
| CN | 202321810 | U | | 7/2012 |
| JP | H06-127771 | A | | 5/1994 |
| JP | H08-245031 | A | | 9/1996 |
| JP | 2004299069 | A | * | 10/2004 |
| JP | 2015-013461 | A | | 1/2015 |
| JP | 2019177961 | A | * | 10/2019 |

OTHER PUBLICATIONS

Mark Hirte et al., Mehtods and Apparatus for Automatically Adjusting Ribbon Tension, Sep. 25, 2006, IP.com: IPCOM000140895D.*

* cited by examiner

*Primary Examiner* — Sharon Polk
(74) *Attorney, Agent, or Firm* — Oliff PLC

(57) ABSTRACT

A winding device includes a winding portion that winds a continuous medium, a friction roller that contacts the continuous medium while the continuous medium is being fed to the winding portion and that applies friction resistance to the continuous medium, and a roller driving portion that causes the friction roller to rotate in a direction in which the continuous medium is fed, in which the roller driving portion includes a roller gear train that transmits rotation of a feed motor, which is input via a winding-portion gear train, to the friction roller.

7 Claims, 6 Drawing Sheets

WINDING DEVICE AND PRINTING SYSTEM

The present application is based on, and claims priority from JP Application Serial Number 2019-105947, filed Jun. 6, 2019, the disclosure of which is hereby incorporated by reference herein in its entirety.

BACKGROUND

1. Technical Field

The present disclosure relates to a winding device that winds a continuous medium and to a printing system.

2. Related Art

To date, as disclosed in JP-A-6-127771, there is a known tape winding device that includes a tension device applying tension to a tape wound by a winding-side roller. The tension device includes an arm member rotatably provided with a tension roller at a distal end portion thereof, and a spring that applies tension to the tape via the arm member.

In a configuration including a friction roller that applies friction resistance to a continuous medium wound by a winding portion, when a tape is fed to the winding portion, there is a problem that noise is generated in the winding device due to a stick-slip phenomenon that occurs between the tape and the friction roller.

SUMMARY

According to an aspect of the present disclosure, a winding device includes a winding portion that winds a continuous medium, a friction roller that contacts the continuous medium while the continuous medium is being fed to the winding portion and that applies friction resistance to the continuous medium, and a roller driving portion that causes the friction roller to rotate in a direction in which the continuous medium is fed.

According to another aspect of the present disclosure, a printing system includes a printing device that prints on a continuous medium, and a winding device that winds the continuous medium fed from the printing device, in which the winding device includes a winding portion that winds the continuous medium, a friction roller that contacts the continuous medium while the continuous medium is being fed to the winding portion and that applies friction resistance to the continuous medium, and a roller driving portion that causes the friction roller to rotate in a direction in which the continuous medium is fed.

DESCRIPTION OF EXEMPLARY EMBODIMENT

Figure 1:
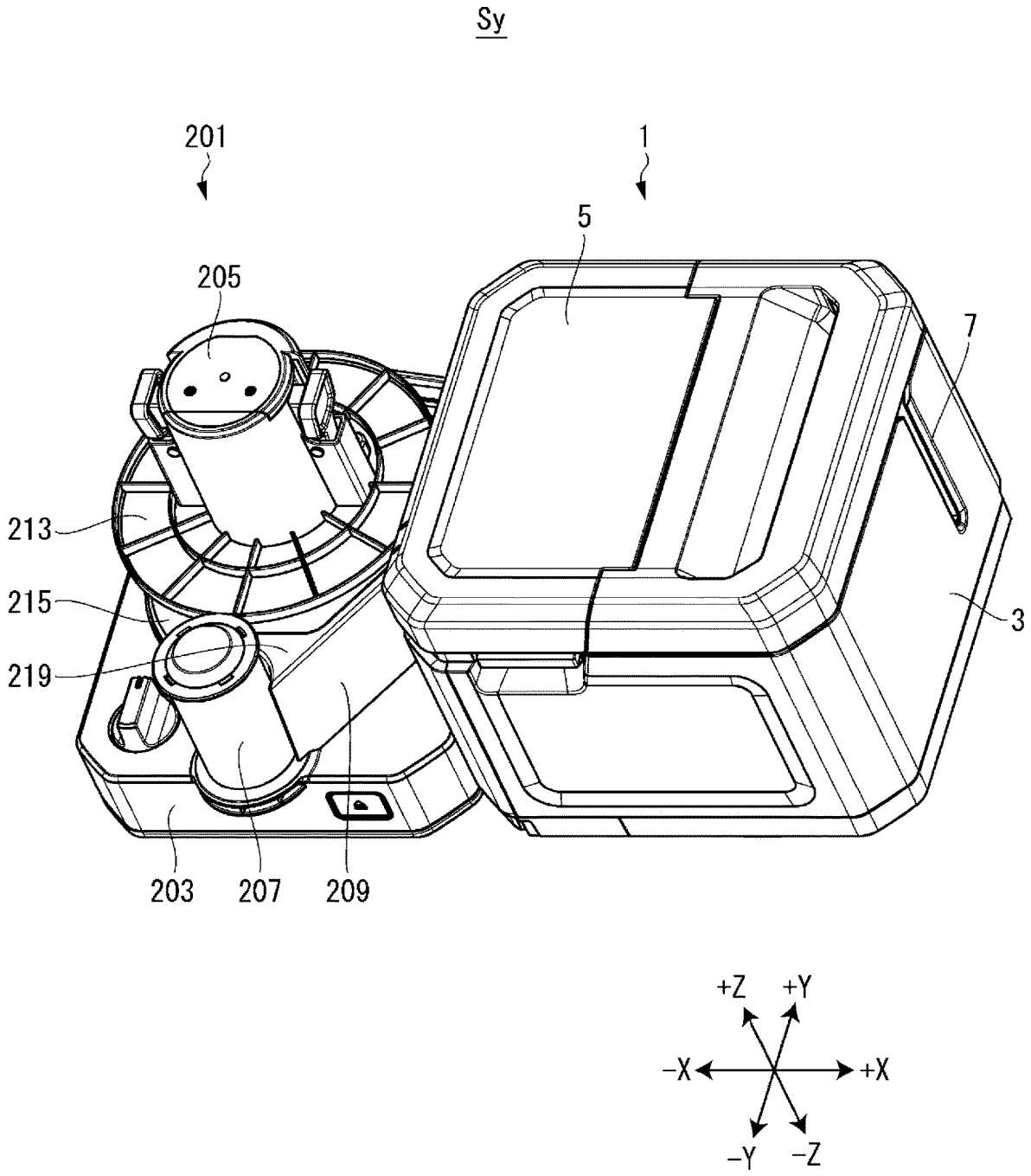
FIG. 1 is a perspective view of a tape printing device and a winding device.

Hereinafter, an embodiment of a winding device and a tape printing system will be described with reference to the accompanying drawings. Further, the XYZ orthogonal coordinate system illustrated in the drawings is merely for convenience of description, and does not limit the following embodiment at all. In addition, the numerical values indicating the number of each portion and the like are merely examples, and do not limit the following embodiment.

Tape Printing System

Figure 2:
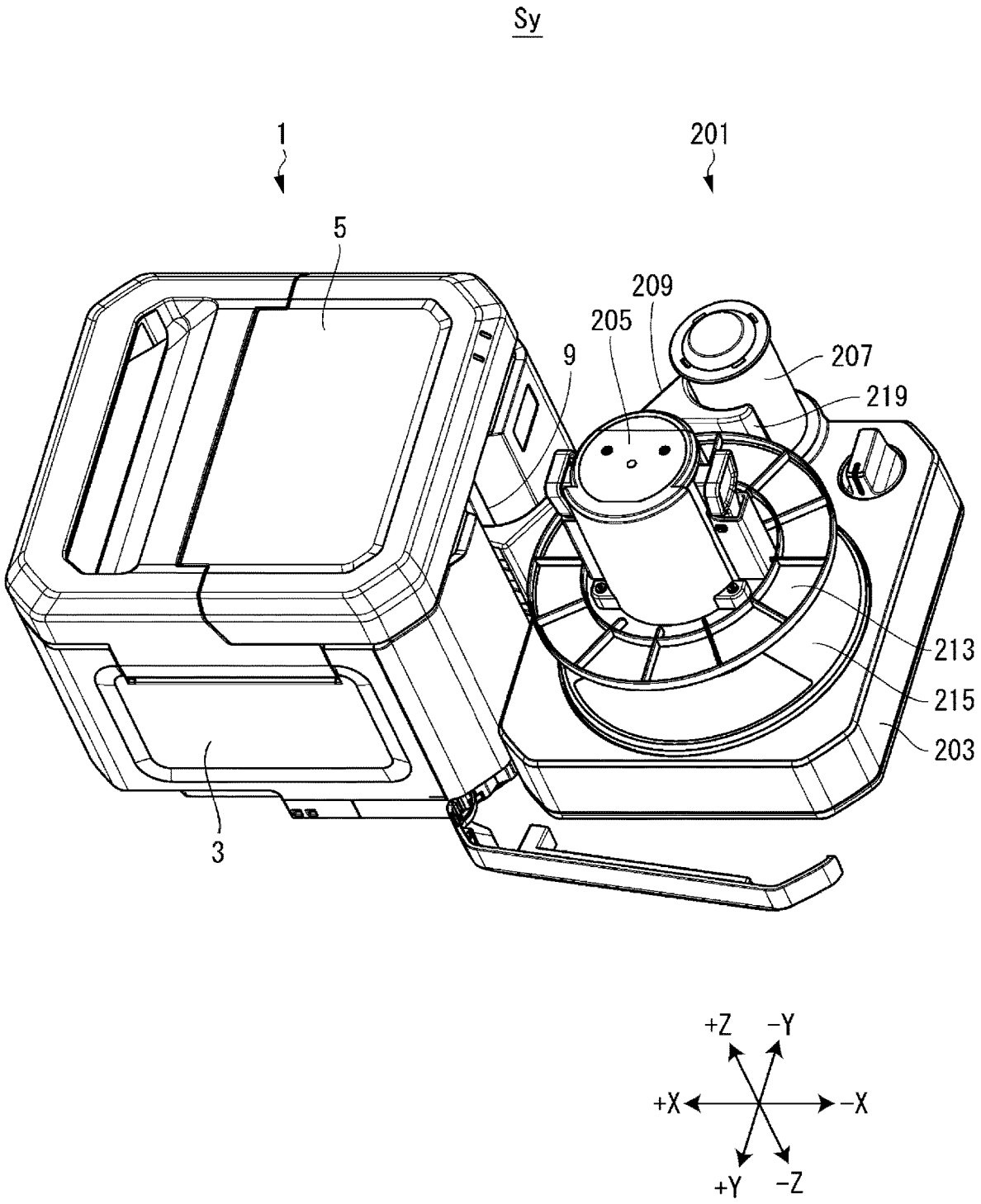
FIG. 2 is a perspective view of the tape printing device and the winding device when viewed from an angle different from that in FIG. 1.

As illustrated in FIGS. 1 and 2, a tape printing system Sy includes a tape printing device 1 and a winding device 201. The tape printing device 1 and the winding device 201 are configured to be coupled to each other. The tape printing device 1 prints on a tape 115 (refer to FIG. 6), and feeds the printed tape 115 to the winding device 201. The winding device 201 winds the tape 115 fed from the tape printing device 1. Further, the tape 115 is an example of a "continuous medium".

Tape Printing Device

Figure 3:
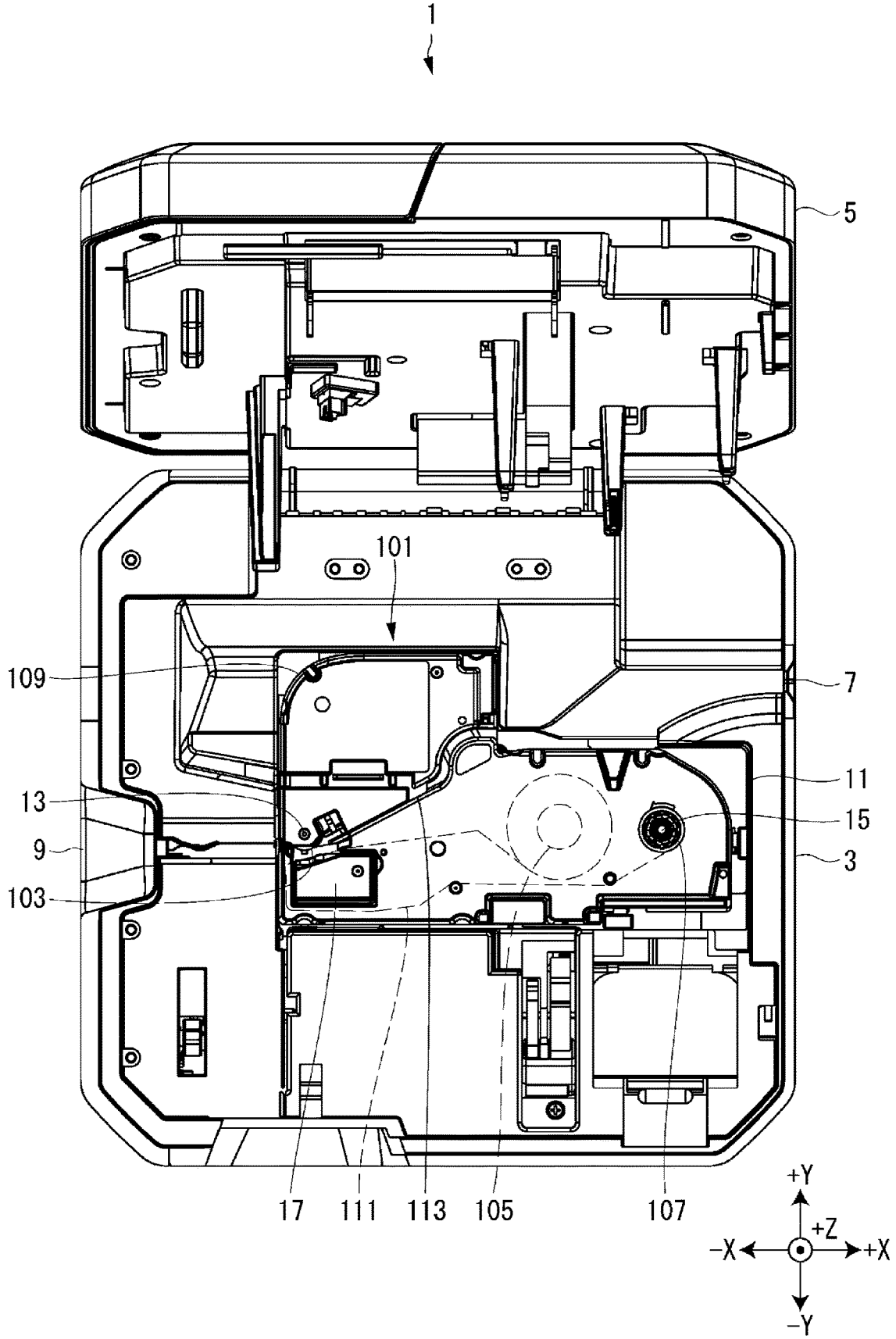
FIG. 3 is a view of the tape printing device when viewed from a +Z side.

As illustrated in FIG. 3, the tape printing device 1 includes a device case 3 and an attachment portion cover 5. The device case 3 is formed in a substantially rectangular parallelepiped shape. In the device case 3, a tape introduction port 7 is provided on a +X-side surface, and a tape discharge port 9 is provided on a −X-side surface. The tape 115 unwound from a tape roll (not illustrated) provided outside the tape printing device 1 is introduced into the tape introduction port 7. After printing is performed on the tape 115 by the tape printing device 1, the tape 115 is discharged from the tape discharge port 9 and fed to the winding device 201. In addition, a cartridge attachment portion 11 is provided on a +Z-side surface of the device case 3. The attachment portion cover 5 opens/closes the cartridge attachment portion 11.

A ribbon cartridge 101 is detachably attached to the cartridge attachment portion 11. The ribbon cartridge 101 includes a platen roller 103, a feeding core 105, a winding core 107, and a cartridge case 109 that houses the aforementioned. An ink ribbon 111 is wound around the feeding core 105. The ink ribbon 111 unwound from the feeding core 105 is wound by the winding core 107. The cartridge case 109 is provided with a tape path 113 that is groove-shaped. The tape 115 introduced from the tape introduction port 7 is fed to the tape discharge port 9 via the tape path 113.

The cartridge attachment portion 11 is provided with a platen shaft 13, a ribbon winding shaft 15, and a print head 17. The platen shaft 13 and the ribbon winding shaft 15 are inserted into the platen roller 103 and the winding core 107, respectively, when the ribbon cartridge 101 is attached to the cartridge attachment portion 11. The tape 115 and the ink ribbon 111 are interposed between the print head 17 and the platen roller 103. The print head 17 is a thermal head having a heating element.

When a feed motor 19 (refer to FIG. 4) operates with the ribbon cartridge 101 attached to the cartridge attachment portion 11, the platen roller 103 and the winding core 107 rotate. Consequently, the tape 115 introduced from the tape introduction port 7 is discharged from the tape discharge port 9 and fed toward the winding device 201. In addition, the ink ribbon 111 unwound from the feeding core 105 of the ribbon cartridge 101 is wound by the winding core 107. At this time, the print head 17 generates heat, so that printing is performed on the tape 115. Further, the platen roller 103 is an example of a "feeding roller".

Winding Device

As illustrated in FIGS. 1 and 2, the winding device 201 is coupled to the tape printing device 1 on the tape discharge port 9 side. The winding device 201 includes a base portion 203, a winding portion 205, a friction roller 207, and a winding guide 209.

Figure 4:
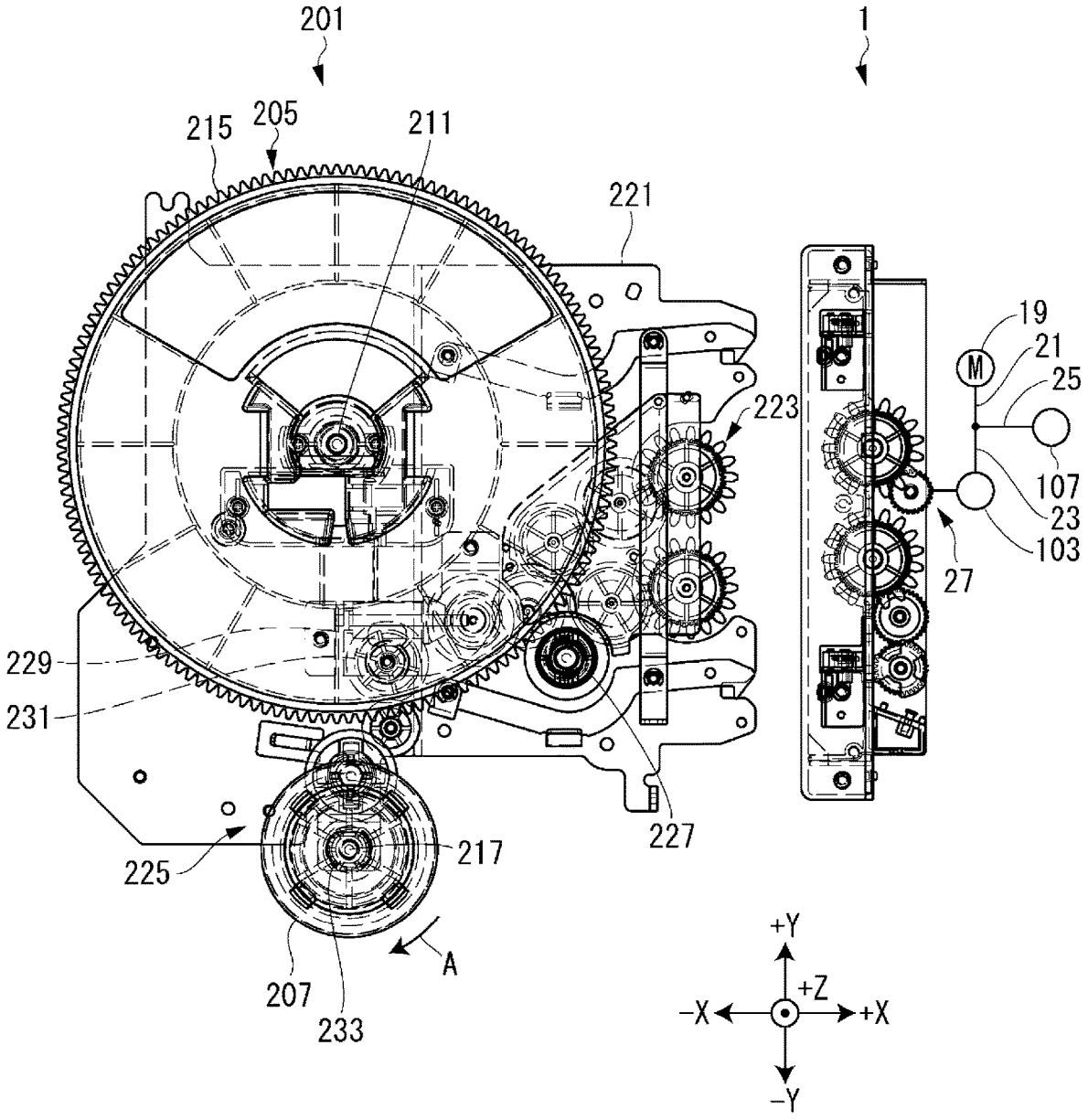
FIG. 4 is a diagram of a gear train of the tape printing device and a gear train of the winding device when viewed from the +Z side.

The winding portion 205 is rotatably supported by a tape winding shaft 211 (refer to FIG. 4). The winding portion 205 has a first flange portion 213 and a second flange portion 215, and the tape 115 fed from the tape printing device 1 is wound between the first flange portion 213 and the second flange portion 215.

The friction roller 207 is formed in a substantially cylindrical shape, and is rotatably supported by a roller shaft 217 (refer to FIG. 4). The friction roller 207 comes into contact with the tape 115 while the tape 115 is being fed from the tape printing device 1 to the winding portion 205, and applies friction resistance to the tape 115. As described later, the friction roller 207 receives the rotation of the feed motor 19 via a roller gear train 225 (refer to FIG. 4) or the like, so that the friction roller 207 rotates in the feeding direction of the tape 115, that is, the direction in which the sliding speed of the tape 115 with respect to the friction roller 207 decreases. Arrow A illustrated in FIG. 4 indicates the rotation direction of the friction roller 207. The friction roller 207 is formed of a material having a high friction coefficient, and, for example, rubber can be used as the material having a high friction coefficient.

The winding guide 209 prevents the tape 115 to be fed from the tape discharge port 9 of the tape printing device 1 to the friction roller 207 from loosening toward the winding portion 205. A roller cover 219 is provided at an end portion of the winding guide 209 on the friction roller 207 side. The roller cover 219 has an arc-shaped side facing the friction roller 207 when viewed from the +Z side, and covers a portion of the friction roller 207, that is, a portion of the friction roller 207 on the winding portion 205 side.

Gear Train

As illustrated in FIG. 4, the tape printing device 1 includes the feed motor 19, a motor gear train 21, a platen gear train 23, a ribbon gear train 25, and an output gear train 27. Further, in FIG. 4, the motor gear train 21, the platen gear train 23, the ribbon gear train 25, and a portion of the output gear train 27 are simply represented by straight lines.

The feed motor 19 is a drive source for the platen roller 103 and the winding core 107. In addition, the feed motor 19 is also a drive source for the winding portion 205 and the friction roller 207, as described later. The motor gear train 21 transmits rotation of the feed motor 19, which is input, to the platen gear train 23 and the ribbon gear train 25. The platen gear train 23 transmits the rotation of the feed motor 19, which is input via the motor gear train 21, to the platen roller 103 and the output gear train 27. The ribbon gear train 25 transmits the rotation of the feed motor 19, which is input via the motor gear train 21, to the winding core 107.

The output gear train 27 transmits the rotation of the feed motor 19, which is input via the platen gear train 23, to a winding-portion gear train 223 of the winding device 201. That is, the gear on the output side of the output gear train 27 meshes with the gear on the input side of the winding-portion gear train 223 when the tape printing device 1 is coupled to the winding device 201.

Figure 5:
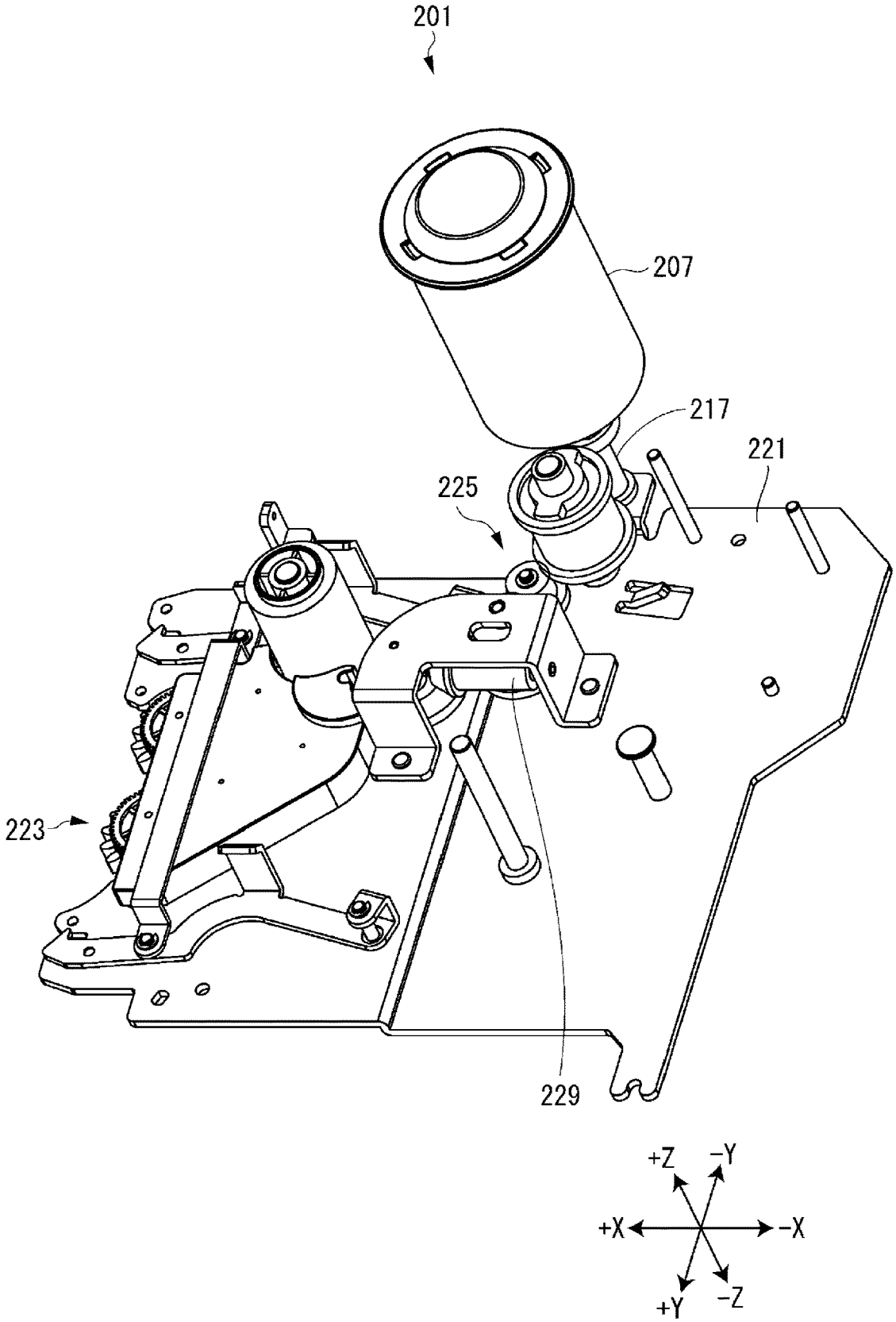
FIG. 5 is a perspective view of the gear train of the winding device.

As illustrated in FIGS. 4 and 5, the winding device 201 includes a frame 221, the winding-portion gear train 223, and the roller gear train 225. The frame 221, the winding-portion gear train 223, and the roller gear train 225 are built into the base portion 203.

The frame 221 is rotatably provided with respective gears forming the winding-portion gear train 223 and the roller gear train 225. In addition, the tape winding shaft 211 and the roller shaft 217 are provided on the frame 221 so as to protrude toward the +Z side.

The winding-portion gear train 223 transmits the rotation of the feed motor 19, which is input via the output gear train 27, to the winding portion 205 and the roller gear train 225. A torque limiter 227 is incorporated in the winding-portion gear train 223. The torque limiter 227 limits the torque transmitted to the winding portion 205.

The roller gear train 225 transmits the rotation of the feed motor 19, which is input via the winding-portion gear train 223, to the friction roller 207. A worm 229 and a worm wheel 231 are incorporated in the roller gear train 225. The worm wheel 231 meshes with the worm 229 and rotates when the rotation of the feed motor 19 is input via the worm 229. On the other hand, the worm 229 cannot directly rotate the worm wheel 231 due to the self-locking action of the worm 229.

Consequently, by providing the tape printing device 1 with the motor gear train 21, the platen gear train 23, the ribbon gear train 25, and the output gear train 27, and providing the winding device 201 with the winding-portion gear train 223 and the roller gear train 225, when the feed motor 19 operates, the platen roller 103, the winding core 107, the winding portion 205, and the friction roller 207 rotate.

Friction Roller

Figure 6:
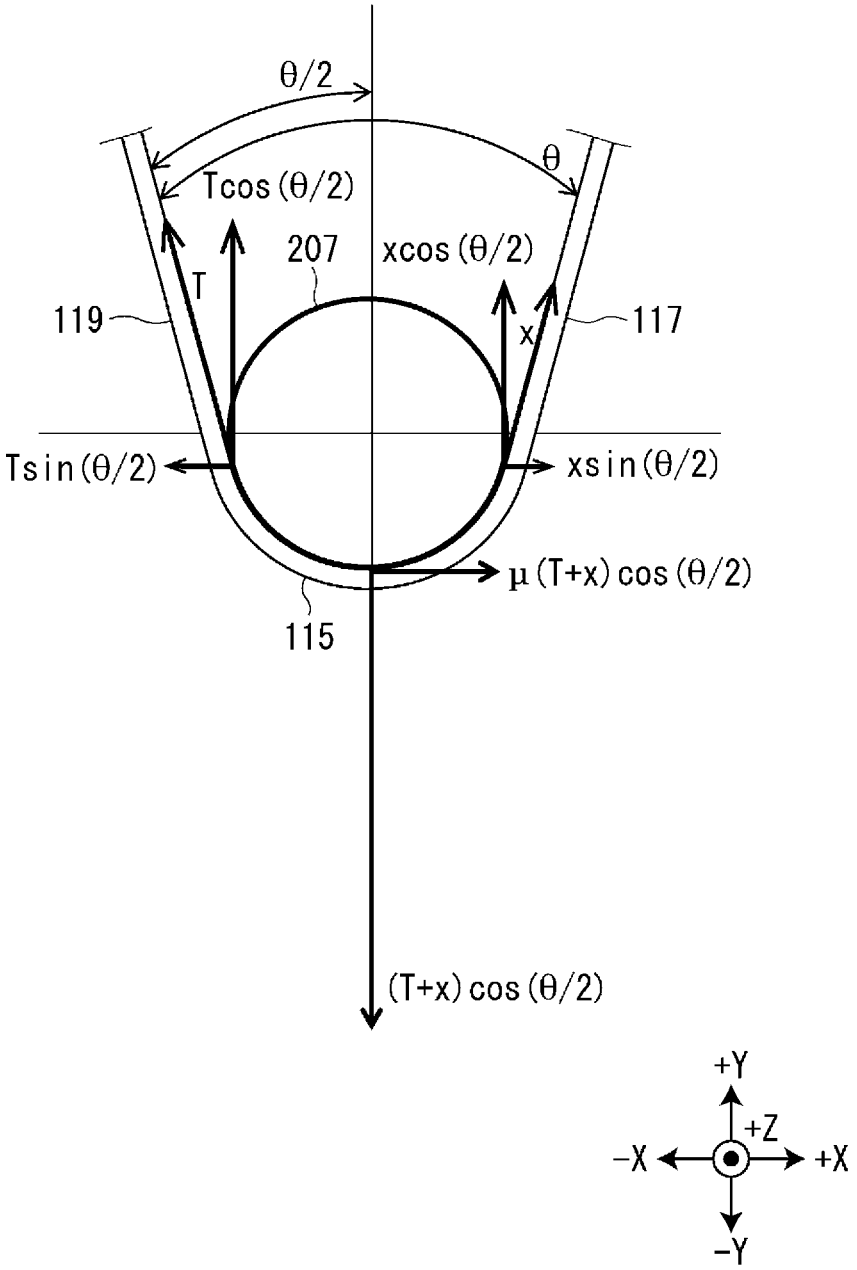
FIG. 6 is a diagram for explaining a function of a friction roller.

Here, the function of the friction roller 207 will be described. As illustrated in FIG. 6, the portion of the tape 115 that is closer to the tape printing device 1 relative to the friction roller 207 is referred to as a printing-side tape 117. In addition, the portion of the tape 115 that is closer to the winding portion 205 relative to the friction roller 207 is referred to as a winding-side tape 119. The angle formed between the printing-side tape 117 and the winding-side tape 119 when viewed from the +Z side, that is, the width direction of the tape 115, is referred to as a medium angle θ.

In addition, a force acting on the winding-side tape 119 toward the winding portion 205, that is, a force with which the winding portion 205 winds the tape 115, is referred to as a winding force T, and a force acting on the printing-side tape 117 toward the tape printing device 1 is referred to as a printing-side acting force x. In this case, a friction resistance F applied to the tape 115 by the friction roller 207 is represented by the following equation (1), where μ is the friction coefficient.

Equation 1

$$F=\mu(T+x)\cos(\theta/2) \quad (1)$$

In addition, the winding force T is expressed by the following equation (2) based on the balance of forces in the feeding direction.

Equation 2

$$T=\mu(T+x)\cos(\theta/2)+x \quad (2)$$

Therefore, when the following equation (3) is satisfied, the winding force T is canceled by the friction resistance F, and the transmission of the winding force T to the printing-side tape 117 is suppressed. This suppresses the printing-side tape 117 from being pulled toward the winding portion 205. Therefore, the tape 115 is fed to the print head 17 with high accuracy.

Equation 3

$$T \leq \mu(T+x)\cos(\theta/2)+x \quad (3)$$

Here, a stick-slip phenomenon occurs between the tape 115 and the friction roller 207. Unlike the present embodiment, in a configuration in which the friction roller 207 is fixed without rotating, the stick-slip phenomenon becomes more pronounced as the winding speed increases, vibration propagates from the friction roller 207 to the entirety of the winding device 201, and noise may be generated in the winding device 201.

In contrast, in the present embodiment, the sliding speed of the tape 115 with respect to the friction roller 207 is reduced by rotating the friction roller 207 in the feeding direction of the tape 115. Accordingly, the occurrence of the stick-slip phenomenon between the tape 115 and the friction roller 207 is suppressed, and thus, the generation of noise in the winding device 201 can be suppressed. Further, although the friction roller 207 is formed of a material having a high friction coefficient as described above, by using a material having a small difference between a coefficient of static friction and a coefficient of kinetic friction, the stick-slip phenomenon can be further suppressed.

In addition, a winding force T acts on the friction roller 207 via the winding tape 119. However, the self-locking action of the worm 229 prevents the friction roller 207 from rotating due to the winding force T. Therefore, the friction roller 207 can efficiently apply the friction resistance F to the tape 115.

Peripheral Speed Relationship

The reduction ratios of the motor gear train 21, the platen gear train 23, the output gear train 27, the winding-portion gear train 223, and the roller gear train 225 are set such that the peripheral speed Va of the winding portion 205, the peripheral speed Vc of the platen roller 103, and the peripheral speed Vd of the friction roller 207 when no load is applied are in this order starting from the fastest. In addition, the peripheral speed Vb of the winding portion 205 at the time of winding becomes equal to the peripheral speed Vc of the platen roller 103 due to the operation of the torque limiter 227. That is, Va>Vb=Vc>Vd.

Since the peripheral speed Vd of the friction roller 207 is lower than the peripheral speed Vc of the platen roller 103, the printing-side tape 117 is prevented from being pulled by the friction roller 207. On the other hand, since the closer the peripheral speed Vd of the friction roller 207 is to the peripheral speed Vc of the platen roller 103, the lower the slip speed of the tape 115 is with respect to the friction roller 207, the effect of suppressing the stick-slip phenomenon is high. Therefore, for example, when the peripheral speed Vc of the platen roller 103 is set to 100, the peripheral speed Vd of the friction roller 207 is preferably 85 or more and 95 or less.

In addition, at the time of winding the tape 115, the torque limiter 227 absorbs a speed difference between the winding speed at which the tape 115 is wound by the winding portion 205 and the feeding speed at which the tape 115 is fed by the platen roller 103. For this reason, regardless of the winding diameter of the tape 115 in the winding portion 205, the tape 115 is wound by the tape winding portion 205, while the tape 115 is kept in a state where an appropriate tension is applied to the tape 115 and at a speed slightly higher than the feeding speed at which the tape 115 is fed by the platen roller 103. For example, assuming that the peripheral speed Vc of the platen roller 103 is 100, the peripheral speed Va of the winding portion 205 when no load is applied is preferably 120 or more and 130 or less.

As described above, according to the present embodiment, because the occurrence of the stick-slip phenomenon between the tape 115 and the friction roller 207 is suppressed by causing the friction roller 207 to rotate in the feeding direction of the tape 115, generation of noise in the winding device 201 can be suppressed.

Other Modifications

It is needless to say that the present disclosure is not limited to the above-described embodiment, and various configurations can be adopted without departing from the gist of the present disclosure. For example, the above embodiment can be changed to the following form in addition to the above.

The winding portion 205 and the friction roller 207 of the winding device 201 are not limited to the configuration in which the feed motor 19 provided in the tape printing device 1 is used as a driving source, and a configuration in which a motor provided in the winding device 201 is used as a driving source may be used. That is, the "roller driving portion" may have a configuration including the roller gear train 225 and the motor, and the winding portion 205 and the friction roller 207 may have a configuration in which a separate motor is used as a driving source.

The worm 229 and the worm wheel 231 are not limited to the configuration in which they are provided in the roller gear train 225, and, for example, the worm 229 and the worm wheel 231 may have a configuration in which they are provided in the winding-portion gear train 223, the output gear train 27, the platen gear train 23 or the motor gear train 21. In addition, as the "self-locking mechanism", instead of the worm 229 and the worm wheel 231, other gears having a self-locking action may be used.

Although the torque limiter 227 is incorporated in the winding-portion gear train 223, a slip spring 233 may be provided between the gear on the output side of the roller gear train 225 and the friction roller 207 without providing the torque limiter 227. The slip spring 233 limits the torque transmitted to the friction roller 207. Consequently, this suppresses a user-s finger or the like from being caught between the friction roller 207 and the roller cover 219. Further, the slip spring 233 is an example of a "torque control portion".

The platen roller 103 is not limited to the configuration in which it is housed in the ribbon cartridge 101, and may have a configuration in which the platen roller 103 is provided in the tape printing device 1. In addition, the tape printing device 1 may have a configuration in which it includes a driving roller and a driven roller instead of the platen roller 103, and feeds the tape 115 interposed between the two rollers.

The tape printing device 1 is not limited to a configuration that enables printing by using a thermal system, and may be configured to perform printing with, for example, an ink jet system, an electrophotographic system, or a dot impact system.

The tape printing device 1 and the winding device 201 may be integrated.

In addition, a configuration combining the above-described embodiment and modifications may be employed.

APPENDIX

The following describes a winding device and printing system.

A winding device includes a winding portion that winds a continuous medium, a friction roller that contacts the continuous medium while the continuous medium is being fed to the winding portion and that applies friction resistance to the continuous medium, and a roller driving portion that causes the friction roller to rotate in a direction in which the continuous medium is fed.

According to this configuration, the occurrence of a stick-slip phenomenon between the continuous medium and the friction roller is suppressed. Therefore, generation of noise in the winding device can be suppressed.

In this case, it is preferable that the winding device further include a winding-portion gear train that transmits rotation of a motor, which is input, to the winding portion, and that the roller driving portion include a roller gear train that transmits the rotation of the motor, which is input via the winding portion gear train, to the friction roller.

According to this configuration, the friction roller can be rotated together with the winding portion by operating the motor.

In this case, it is preferable that the roller driving portion have a gear train that transmits rotation of a motor, which is input, to the friction roller, and that the gear train include a self-locking mechanism that prevents the friction roller from rotating by a winding force with which the winding portion winds the continuous medium.

According to this configuration, the friction roller is prevented from rotating by the winding force. For this reason, the friction roller can efficiently apply friction resistance to the continuous medium.

In this case, it is preferable that the self-locking mechanism include a worm and a worm wheel meshed with the worm.

According to this configuration, the self-locking mechanism can be easily formed.

In this case, it is preferable that the winding device further include a roller cover that covers a portion of the friction roller, and that the roller driving portion have a torque control portion that limits a torque transmitted to the friction roller.

According to this configuration, a user□s finger or the like is prevented from being caught between the friction roller and the roller cover.

A printing system includes a printing device that prints on a continuous medium, and a winding device that winds the continuous medium fed from the printing device, in which the winding device includes a winding portion that winds the continuous medium, a friction roller that contacts the continuous medium while the continuous medium is being fed to the winding portion and that applies friction resistance to the continuous medium, and a roller driving portion that causes the friction roller to rotate in a direction in which the continuous medium is fed.

According to this configuration, the occurrence of a stick-slip phenomenon between the continuous medium and the friction roller is suppressed. Therefore, generation of noise in the winding device can be suppressed.

In this case, it is preferable that the printing device include a motor used as a drive source of a feeding roller that feeds the continuous medium, that the winding device include a winding-portion gear train that transmits rotation of the motor, which is input, to the winding portion, and that the roller driving portion have a roller gear train that transmits the rotation of the motor, which is input via the winding portion gear train, to the friction roller.

According to this configuration, the friction roller can be rotated together with the winding portion by operating the motor.

In this case, it is preferable that a peripheral speed of the friction roller be lower than a peripheral speed of a feeding roller that feeds the continuous medium in the printing device.

According to this configuration, the continuous medium is suppressed from being pulled by the friction roller.

What is claimed is:

1. A winding device comprising:

a winding portion that winds a continuous medium fed from a printing device;

a friction roller that contacts the continuous medium while the continuous medium is being fed to the winding portion and that applies friction resistance to the continuous medium; and a roller driving portion that causes the friction roller to rotate in a direction in which the continuous medium is fed, wherein a peripheral speed of the friction roller is lower than a peripheral speed of a feeding roller that feeds the continuous medium in the printing device.

2. The winding device according to claim 1, further comprising a winding-portion gear train that transmits rotation of a motor, which is input, to the winding portion, wherein the roller driving portion includes a roller gear train that transmits the rotation of the motor, which is input via the winding-portion gear train, to the friction roller.

3. The winding device according to claim 1, wherein the roller driving portion has a gear train that transmits rotation of a motor, which is input, to the friction roller, and the gear train includes a self-locking mechanism that prevents the friction roller from rotating by a winding force with which the winding portion winds the continuous medium.

4. The winding device according to claim 3, wherein the self-locking mechanism includes a worm and a worm wheel meshed with the worm.

5. The winding device according to claim 1, further comprising a roller cover that covers a portion of the friction roller, wherein the roller driving portion has a torque control portion that limits a torque transmitted to the friction roller.

6. A printing system comprising:

a printing device that prints on a continuous medium; and a winding device that winds the continuous medium fed from the printing device, wherein the winding device includes a winding portion that winds the continuous medium, a friction roller that contacts the continuous medium while the continuous medium is being fed to the winding portion and that applies friction resistance to the continuous medium, and a roller driving portion that causes the friction roller to rotate in a direction in which the continuous medium is fed, and a peripheral speed of the friction roller is lower than a peripheral speed of a feeding roller that feeds the continuous medium in the printing device.

7. The printing system according to claim 6, wherein the printing device includes a motor used as a drive source of a feeding roller that feeds the continuous medium, the winding device includes a winding-portion gear train that transmits rotation of the motor, which is input, to the winding portion, and the roller driving portion includes a roller gear train that transmits the rotation of the motor, which is input via the winding-portion gear train, to the friction roller.

* * * * *